US005347347A

United States Patent [19]

Hilbert et al.

[11] Patent Number: 5,347,347

[45] Date of Patent: Sep. 13, 1994

[54] APPARATUS FOR APPLYING TONER TO AN ELECTROSTATIC IMAGE HAVING IMPROVED DEVELOPER FLOW

[75] Inventors: Thomas K. Hilbert, Spencerport; Theodore H. Morse, Rochester, both of N.Y.

[73] Assignee: Eastman Kodak Company, Rochester, N.Y.

[21] Appl. No.: 66,264

[22] Filed: May 25, 1993

[51] Int. Cl.[5] ..... G03G 15/09

[52] U.S. Cl. ..... 355/253; 355/245; 355/251; 492/18; 118/656

[58] Field of Search ..... 355/245, 251, 253; 228/653, 656-658, 661; 492/8, 18, 25, 28

[56] References Cited

U.S. PATENT DOCUMENTS 4,597,661 7/1986 Yamashita ..... 118/658 X 5,084,733 1/1992 Katoh et al. ..... 355/251

5,162,854 11/1992 Hilbert et al. ..... 355/245

5,177,536 1/1993 Watanabe et al. ..... 355/251

5,196,887 3/1993 Hilbert et al. ..... 355/251

5,202,729 4/1993 Miyamoto et al. ..... 355/251

*Primary Examiner*—Matthew S. Smith

*Attorney, Agent, or Firm*—Leonard W. Treash, Jr.

[57] ABSTRACT

Apparatus for applying toner to an electrostatic image includes a sump for holding developer, which developer preferably includes a component having high coercivity and permanent magnetism. An applicator for moving the developer through a development zone includes a rotatable magnetic core and a sleeve around the core, which sleeve includes roughened portions leading to and away from the development zone and a smooth portion directly facing the development zone. The sleeve may also have smooth portions on its lateral crosstrack edges.

7 Claims, 4 Drawing Sheets

APPARATUS FOR APPLYING TONER TO AN ELECTROSTATIC IMAGE HAVING IMPROVED DEVELOPER FLOW

This invention relates to the development of electrostatic images by the application of toner. More specifically, it relates to such apparatus in which a developer having a magnetic component is moved around a sleeve by the rotation of a magnetic core within the sleeve.

U.S. Pat. No. 5,162,854, issued to Hilbert et al Nov. 10, 1992 is illustrative of a number of references showing a magnetic brush toning apparatus in which a two component developer including hard magnetic carrier particles and insulating toner is moved around a sleeve or shield of an applicator by a rotating magnetic core located inside the sleeve. The rotating magnetic core has a number of opposite poles around its periphery. Its rotation creates rapid pole transitions on the surface of the sleeve which are resisted by high coercivity carrier particles in the developer. This resistance causes the carrier particles to flip and move around the sleeve. Movement around the sleeve is assisted by roughening the surface of the sleeve. In fact, U.S. Pat. No. 5,162,854 suggests that a size 400 grit applied to a downstream skive will assist in the movement of small spherical carrier particles that have a tendency to accumulate at the beginning of a polished skive surface.

Prior development devices of this type fell into several types according to whether the sleeve was moved in addition to the core. In general, the device can be designed with the sleeve moving either with or against the flow of developer or with the sleeve stationary. Stationary sleeves have certain advantages, among them being simplicity of construction and more flexibility in controlling the developer path.

SUMMARY OF THE INVENTION

In working with a stationary sleeve and small spherical carrier particles, additional problems arose associated with a buildup of a layer of toner on the sleeve in a development zone facing the electrostatic image. This buildup is a form of a coating we call "plateout", on the roughened roller surface. The charge on this toner layer adversely affects the developed density of subsequent images. Further, when this type of development device is used with a relatively noncompliant image member, for example, a typical photoconductive drum, developer has a tendency to accumulate on the lateral edges of the development zone whether or not the sleeve is rotatable. This uncontrolled developer constitutes a source of contamination and a loss of developer from the developer station. If the apparatus is a color machine in which a given station only develops some of the electrostatic images passing it, this developer can cause the wrong color of toner to be deposited on an electrostatic image.

It is an object of the invention to correct one or both of the above problems in an apparatus for applying toner to an electrostatic image.

This and other objects are accomplished by an apparatus for applying toner to an electrostatic image carried by an image member, which apparatus includes a sump for holding a developer including hard magnetic carrier particles and insulating toner particles. An applicator for moving such developer through a development zone in toning relation to the electrostatic image includes a rotatable magnetic core having alternating magnetic poles which core is rotatable around an axis of rotation. The applicator also includes a sleeve around the core, which sleeve has an outside surface, the outside surface having a portion in the development zone facing the electrostatic image and portions leading to and away from the development zone. The surface is made rough in the portion leading to the development zone but less rough or smooth in the portion in the development zone and facing the electrostatic image. The device also includes means for rotating the magnetic core to move developer along a path along the surface of the sleeve, first across the toughened portion leading to the development zone and then through the development zone to the portion leading away from the development zone.

According to a preferred embodiment, the portion leading away from the development zone is also rough compared to the portion in the development zone.

According to a further preferred embodiment, the sleeve has additional portions at the crosstrack edges of the developer path that are smooth or less rough than the central portion of the portion of the sleeve leading to the development zone. Although this is preferably combined with the feature of the smooth surface facing the electrostatic image, it also can be used independently and, in fact, can be used with a rotating sleeve as well as a stationary sleeve.

The performance of the patterned sleeve constructed according to the preferred embodiments was tested against a sleeve that was entirely roughened. The toner plate-out on the totally roughened roller resulted in a decrease in image density as succeeding images were made. However, with the pattern sleeve no such decrease was observed. Similarly, the migration of developer to the ends or edges of the sleeve was observed with the roughened sleeve when developing images against a relatively noncompliant drum type image member after one or two images. With the patterned surface sleeve, no developer was found on the ends of the sleeve, even after extended use.

Although the invention can be used with any shape of hard magnetic carrier particle, irregularly shaped carrier particles have less tendency toward the problems addressed. Thus, the invention is particularly usable with spherically shaped hard magnetic carrier particles.

DESCRIPTION OF THE PREFERRED EMBODIMENTS

This invention solves problems that are most severe in the use of small, spherical carrier particles on a stationary shell with a noncompliant image member. However, this invention also has advantages where the problem is not as severe, for example, with larger, irregularly shaped carrier or even single component magnetic developer and with a more compliant image member including belt image members. The results are not as remarkable because the problem in these cases is not as severe. The actual description will be in terms of the situation in which the problem is most severe.

Figure 1:
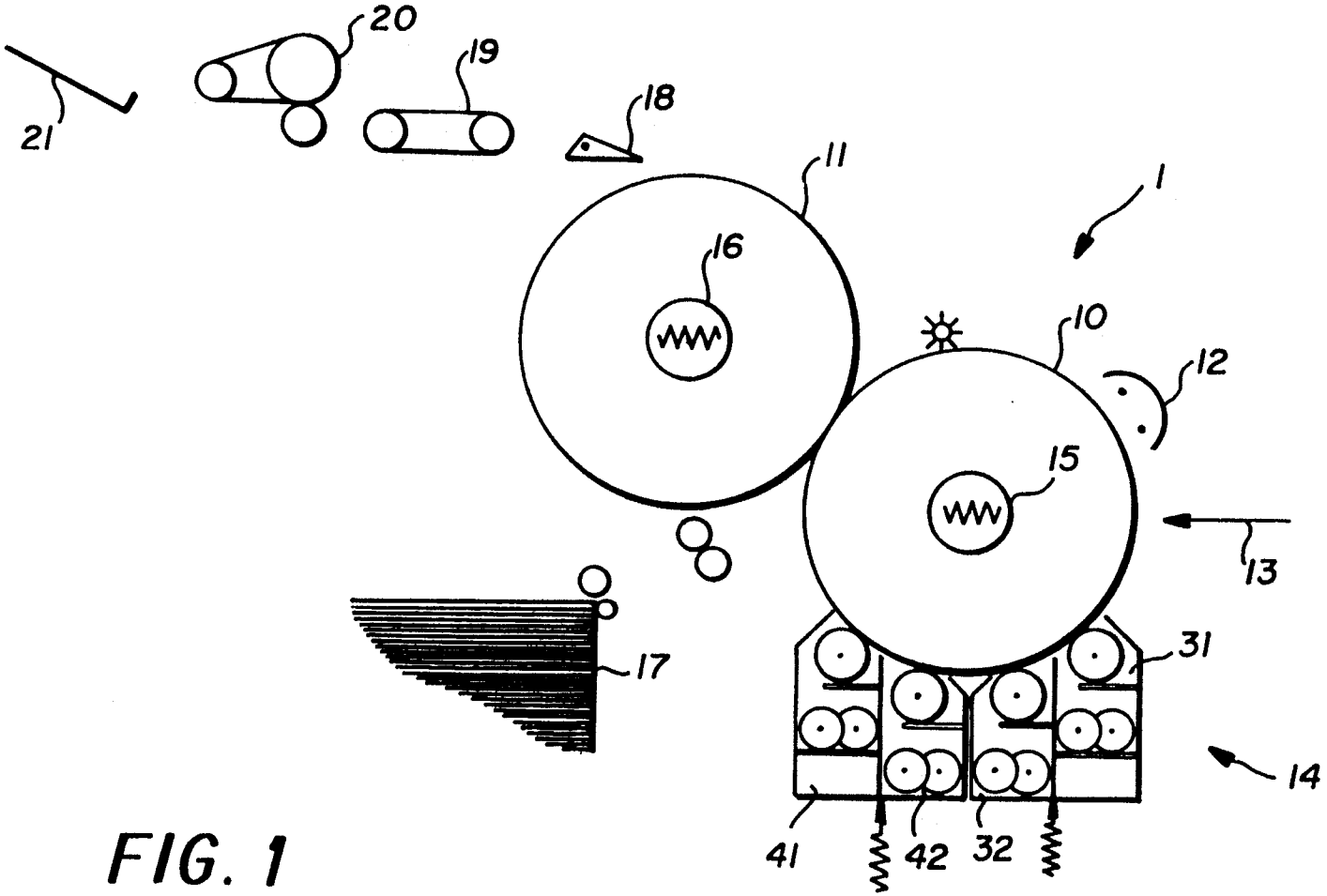
FIG. 1 is a side schematic of an image forming apparatus.

According to FIG. 1, an image forming apparatus 1 includes a drum-shaped image member 10 of a typical electrophotographic type having one or more photoconductive layers on its periphery. Image member 10 is rotated past a series of stations for forming a series of different color toner images. Image member 10 is uniformly charged at a charging station 12 and imagewise exposed by an exposure device, for example, by a laser 13, to create a series of electrostatic images. Each of the series of electrostatic images is toned by one of a series of toning stations 14, which toning stations each contain a different color toner to create a series of different color toner images. The different color toner images are transferred in registration to a receiving sheet which has been fed from a receiving sheet supply 17 to the periphery of a transfer drum 11. Transfer can be accomplished by conventional electrostatic transfer. However, as shown in FIG. 1, transfer is accomplished by a combination of heat and pressure with transfer member 11 being heated internally by a lamp 16 to a temperature sufficient to sinter the toner particles where they touch the receiving sheet and where they touch each other. Image member 10 can also be internally heated by a lamp 15 to assist in the transfer process but the temperature of the photoconductive layers cannot be raised excessively lest they lose their ability to hold charge. After the series of images has been transferred in registration to the receiving sheet, the receiving sheet is separated by a receiving sheet skive 18 from transfer drum 11 and transported by a transport 19 to a fuser 20 where the multicolor image is fixed. The receiving sheet is ultimately deposited in an output tray 21.

Figure 2:
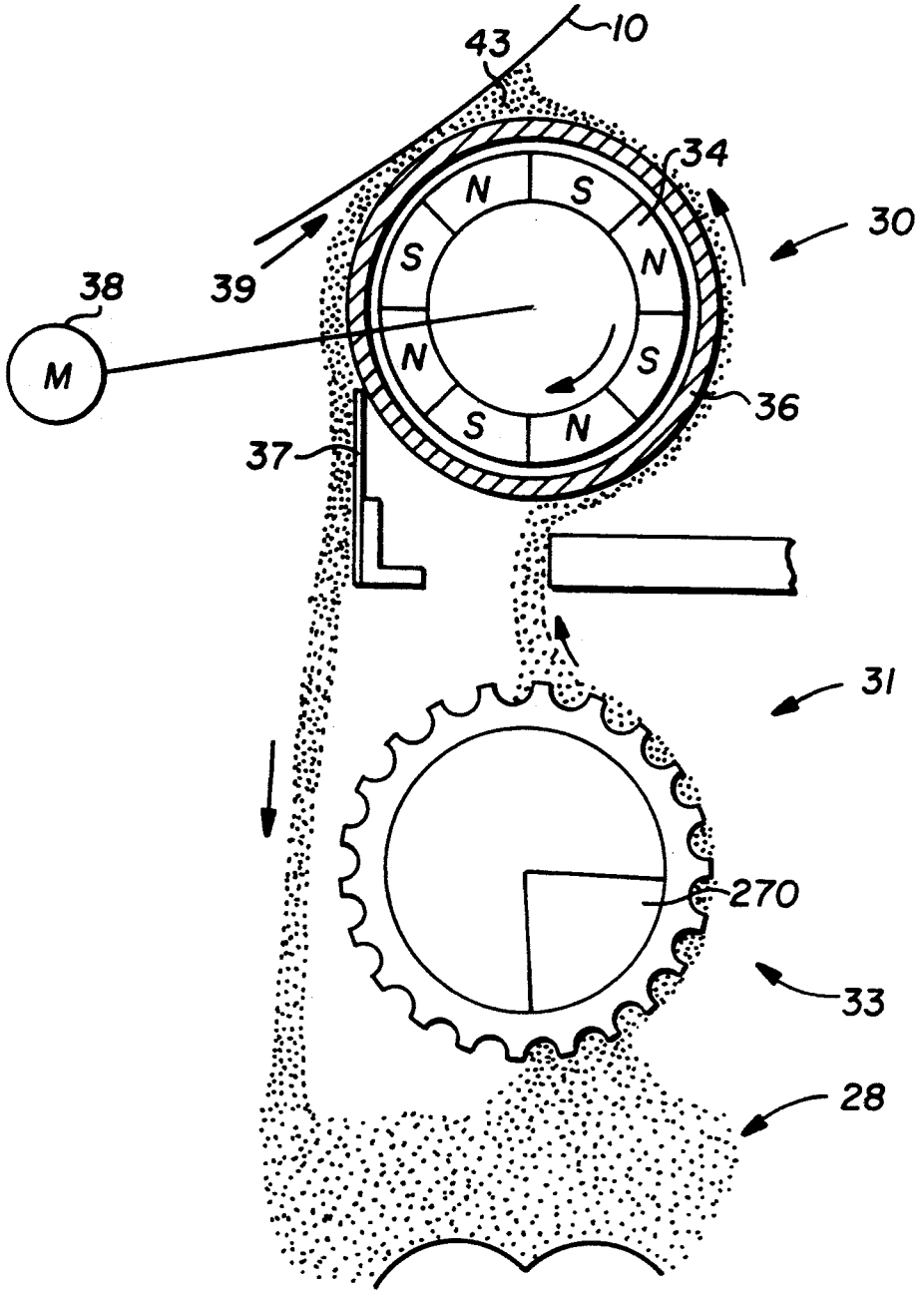
FIG. 2 is a schematic section of a portion of a developing device.

Development device 14 includes four development stations 31, 32, 41 and 42, each containing a different color toner. A portion of toning station 31 is shown in FIG. 2 which illustrates the normal movement of developer in this type of toning station. Developer from a sump 28 is picked up by a developer transport 33 and transported to an applicator 30 which, in turn, applies it to an electrostatic image on image member 10. Transport 33 also functions as a valve which can shut off the flow of developer to applicator 30. Details of this valve and other operations of the toning station are more thoroughly explained in the above-mentioned U.S. Pat. No. 5,162,854 to Hilbert et al, issued Nov. 10, 1992, which patent is hereby incorporated by reference herein. A magnet 270 inside transport 33 is rotatable to a position in which it attracts developer from sump 28 to transport 33, as shown in FIG. 2, to a position opposite applicator 30 in which it no longer attracts developer from sump 28 but instead inhibits the flow of developer from transport 33 to applicator 30.

Applicator 30 includes a rotatable magnetic core 34 inside of a sleeve 36. Magnetic core 34 has alternating permanent pole magnets around its periphery. Rotation of the core causes rapid pole transitions on the surface of sleeve 36. Developer in sump 28 has component particles having high coercivity and permanent magnetism. Such particles resist the pole transitions and flip in response to them. The flipping action of the developer causes it to move around the sleeve 36 in a direction opposite to the rotation of magnetic core 34. Thus, as shown in FIG. 2, a motor 38 drives magnetic core 34 in a clockwise direction to move developer around the outside of sleeve 36 in a counter-clockwise direction from a position at the bottom of sleeve 36 where the developer is picked up from transport 33 to a development zone 39 where the sleeve directly faces the electrostatic image on image member 10. As the developer leaves the development zone, it continues to be moved by rotation of magnetic core 34 down the portion of the sleeve leading away from the development zone to a skive 37 where the developer is skived from the sleeve and ultimately falls into sump 28 for remixing.

Commercial applications of this basic technology provide extremely high quality development. In some such applications, sleeve 36 is rotated to either increase the flow of developer or reduce it, depending upon the direction of rotation. Other applications keep the sleeve stationary. Such stationary sleeve applications have an advantage of being considerably less expensive and provide some developer path flexibility in that the sleeve need not be cylindrical in shape. The sleeve 36 in FIG. 2 is stationary.

Typically the sleeve is toughened to assist in the movement of the developer. As described in U.S. Pat. No. 5,162,854, this toughening is quite important when using spherical magnetic carrier particles or spherical toner particles. The spherical carrier is more difficult to move on a smooth surface compared to a more irregular carrier particle. The smaller the carrier particle also the more difficult to get it to move on the sleeve without roughening the sleeve. As pointed out in the Hilbert et al patent, movement of such particles even downward on a vertically oriented skive, such as skive 37, is difficult without roughening the surface of the skive. Using a 400 grit toughened outer surface for sleeve 36 generally provides good movement even of small spherical carrier particles. However, it is not without its own set of problems. First, a thin layer of toner has a tendency to form on the portion of the stationary sleeve 36 facing the electrostatic image. This layer of toner forms over time and has a tendency to reduce the density of the images.

Figure 3:
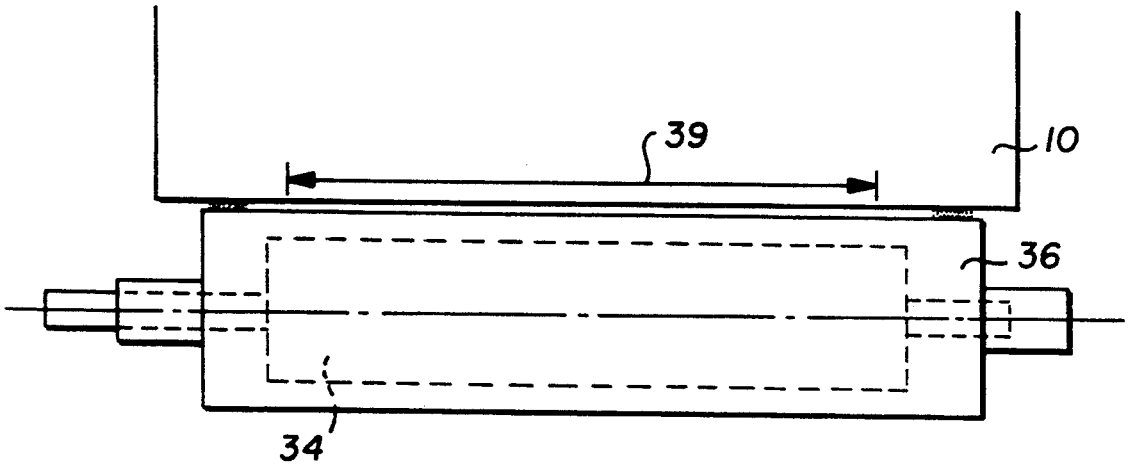
FIGS. 3 and 5 are front views of the applicator portion of a developing device.

Secondly, there is a tendency for some of the developer to move outside of the image area and, because of somewhat reduced magnetic fields, not to continue to move around the sleeve. This nonmoving developer makes it difficult to maintain the general cleanliness of the system and also makes it difficult to clean off the development zone when an electrostatic image is passing through it that is not to be toned, for example, an electrostatic image to be toned with a different one of the toner stations in developing device 14, shown in FIG. 1. If there is residual developer in this area when the wrong electrostatic image comes through, some of the toner from that developer will be picked up by the image and change the ultimate color of the image. This second problem is exacerbated by a rollback 43 of developer shown in FIG. 2. This condition is also made more serious when image member 10 is relatively noncompliant, for example, when the image member is supported by a drum. It is not so great a problem if the image member is a web without a hard backing in the development zone, since the web will give somewhat to the rollback condition, whereas the hard drum will push the rollback developer outward. This phenomenon is illustrated in FIG. 3 in which it can be seen that the magnetic core 34 does not extend in a crosstrack direction fully to the ends of sleeve 36. As a result, there is a buildup of developer outside of the main influence of the magnetic core. This is also outside of the development zone which is generally indicated to be equal in crosstrack dimension to the image zone of image member 10.

Figure 4:
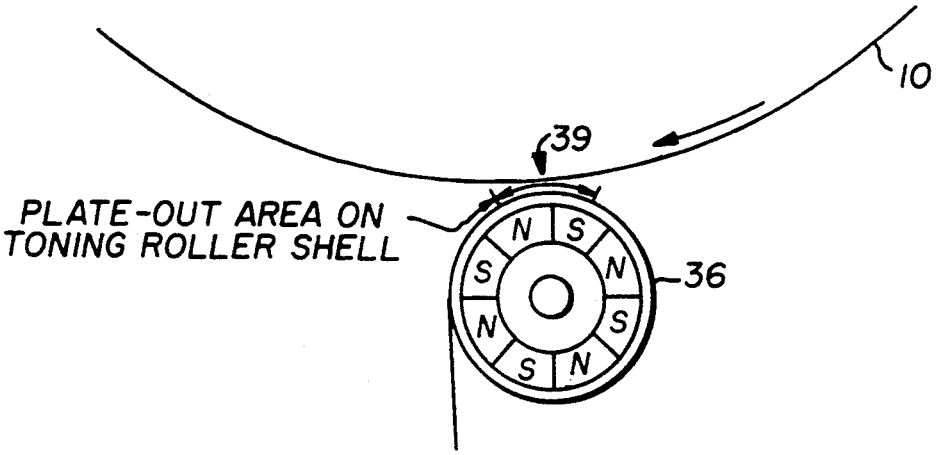
FIG. 4 is a side schematic section of a portion of a developing device.
Figure 5:
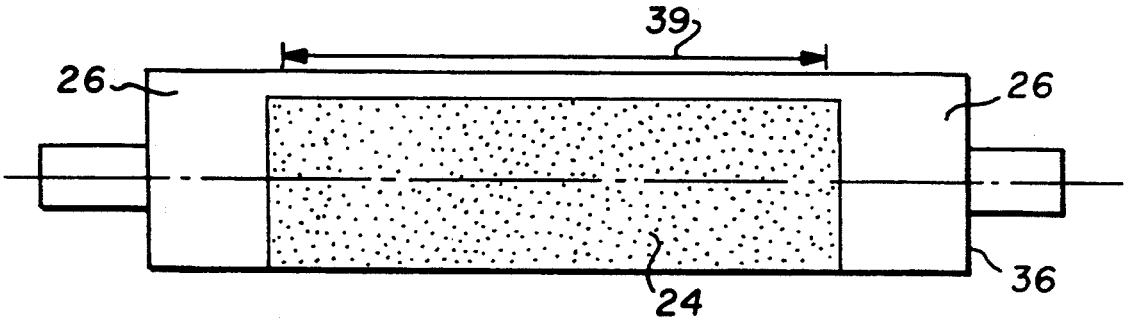

We have solved both of these problems by providing a particular pattern to the roughness on sleeve 36. First, as shown in FIG. 4 and 5, a portion of the sleeve 36 in the development zone 39 facing the electrostatic image on image member 10 is smooth or polished. The portions 24 of the sleeve 36 leading to the development zone and away from the development zone 39 are roughened. With this configuration, developer is moved into the development zone on the roughened portion of the shell. When it reaches the polished or smooth portion of the shell in the development zone, the developer coming into the zone helps keep that developer moving through the zone. When this was tried, we found that the loss in density we had been experiencing with the totally roughened shell disappeared without our observing any adverse side effects.

Secondly, portions 26 of the shell 36 outside the path of developer moving through, to or from the development zone were also made smooth or polished. As shown in FIG. 5, these portions 26 are preferably slightly outside what would be the development zone 39. Surprisingly, what we found was that developer that had a tendency to "walk" laterally outside of the influence of the magnetic fields either did not continue past the original portion of the polished areas or was recaptured by the magnets and moved back into the regular flow of the developer. The buildup of developer, shown in FIG. 3, was largely eliminated.

The first feature of polishing the portion of the shell in the development zone is usable only with a stationary sleeve similar to that shown in the FIGS. However, the second feature of polishing the lateral crosstrack edges of the sleeve could also be used with rotating sleeve systems.

Further, while the conditions causing the second problem are exacerbated by a noncompliant image member, both improvements, and especially the first improvement, would also have application to image members in the form of more compliant systems, for example, webs that are not rigidly backed in the development zone.

Figure 6:
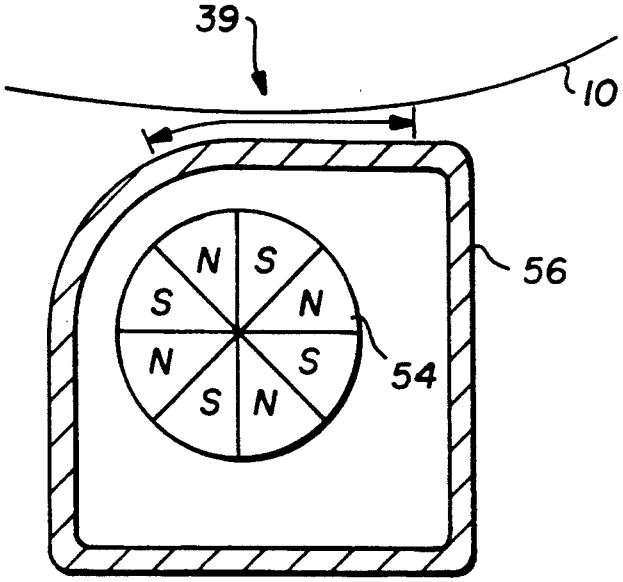
FIG. 6 is a schematic section of a portion of an alternative developing device.

FIG. 6 illustrates that the invention can be used with stationary sleeves or shells that are not cylindrical. In this instance, a shell or sleeve 56 is shaped to provide a somewhat longer development zone 39 than would be possible with a cylindrical sleeve or shell. This extended development zone is used in some instances to increase development completion in this type of apparatus. In this instance, the portion of sleeve 56 that leads to and away from development zone 39 is roughened while the area in development zone 39 or a substantial portion of it is polished or smooth. Similarly, the second effect can also be used with the lateral edges of shell 56 being polished or smooth.

The shell is typically a thin walled hollow cylinder of nonmagnetic metal such as stainless steel or aluminum. A stainless shell is commonly chrome plated. The selective roughening process can be carried out either before or after the chrome plating. For example, if the chrome plating is already in place, it can be removed by an electrochemical process before toughening by air gun blasting with glass beads, for example, beads of No. 200 size. For the present invention, where a pattern of toughened and polished areas is desired, selective removal of the chromium plating is accomplished by suitably masking the desired areas during the removal process. Similarly, the polished or smooth areas where the chromium remains are then masked while the remainder of the surface is blasted.

Alternatively, unplated shell tubing can be first masked in the proposed polished areas and bead blasted. Then the entire shell can be chrome plated. We have found the chromium over the roughened or smooth areas does not adversely affect its function.

Although best results were obtained with a shell or sleeve roughened to 400 grit, hard magnetic spherical carrier can be moved across a surface somewhat less rough, for example, as low as a peak-to-valley roughness of 75 microinches. The polished areas that gave the good results noted above were measured at between 8 and 12 microinches, peak-to-valley.

The invention has been described in detail with particular reference to a preferred embodiment thereof, but it will be understood that variations and modifications can be effected within the spirit and scope of the invention as described hereinabove and as defined in the appended claims.

We claim:

1. Apparatus for applying toner to an electrostatic image carried by an image member, said apparatus comprising:

a sump for holding a dry developer having a high coercivity component, an applicator for moving such developer through a development zone in toning relation to the electrostatic image, the applicator including a magnetic core having alternating magnetic poles and being rotatable around an axis of rotation, a stationary sleeve around the core which sleeve has an outside surface, the outside surface having a portion in the development zone facing the electrostatic image and portions leading to and away from the development zone, said surface being rough in the portion leading to the development zone but smooth or less rough in the portion in the development zone, and means for rotating the core to move developer along a path along said surface first across the toughened portion leading to the development zone and then through the development zone to the portion leading away from the development zone.

2. Apparatus according to claim 1 wherein the portion leading away from the development zone is also rough compared to the portion in the development zone.

3. Apparatus according to claim 2 wherein the rough portions are roughened to at least 75 microinches, peak-to-valley.

4. Apparatus according to claim 1 wherein the sleeve surface has an additional portion at lateral crosstrack edges of the sleeve that are smooth or less rough than the rest of the portion of the sleeve leading to the development zone.

5. Image forming apparatus comprising:

a photoconductive drum, means for forming an electrostatic image on the photoconductive drum, and apparatus for applying toner to the electrostatic image, said apparatus including a sump for holding a dry developer having a high coercivity component, an applicator for moving such developer through a development zone in toning relation to the electrostatic image, the applicator including a magnetic core having alternating magnetic poles and being rotatable around an axis of rotation, a stationary sleeve around the core which sleeve has an outside surface, the outside surface having a portion in the development zone facing the electrostatic image and portions leading to and away from the development zone, said surface being rough in the portion leading to the development zone but smooth or less rough in the portion in the development zone, the sleeve surface further having an additional portion at lateral crosstrack edges of the sleeve that are smooth or less rough than the rest of the portion of the sleeve leading to the development zone, and means for rotating the core to move developer along a path along said surface first across the roughened portion leading to the development zone and then through the development zone to the portion leading away from the development zone.

6. Image forming apparatus comprising:

a movable image member, means for forming a series of electrostatic images on the movable image member, and means for applying a different color toner to each of the series of electrostatic images to form a series of different color toner images, said means for applying including a plurality of apparatus for applying toner to an electrostatic image, each apparatus including a sump for holding a dry developer having a high coercivity component, an applicator for moving such developer through a development zone in toning relation to the electrostatic image, the applicator including a magnetic core having alternating magnetic poles and being rotatable around an axis of rotation, a stationary sleeve around the core which sleeve has an outside surface, the outside surface having a portion in the development zone facing the electrostatic image and portions leading to and away from the development zone, said surface being rough in the portion leading to the development zone but smooth or less rough in the portion in the development zone, the sleeve surface further having an additional portion at lateral crosstrack edges of the sleeve that are smooth or less rough than the rest of the portion of the sleeve leading to the development zone, and means for rotating the core to move developer along a path along said surface first across the roughened portion leading to the development zone and then through the development zone to the portion leading away from the development zone.

7. A sleeve for a toner applicator, which applicator is of the type having a rotatable magnetic core, said sleeve being positionable around the core and having a portion positionable in the development zone of a toner applying apparatus, said sleeve having an outside surface having a development zone portion positioned to face an electrostatic image to be developed and portions leading to and away from the development zone portion, said surface being rough in the portions leading to and away from the development zone but less rough or smooth in the development zone portion.

* * * * *